United States Patent [19]

Dickie

[11] Patent Number: 4,963,104

[45] Date of Patent: Oct. 16, 1990

[54] SHIELDED CONNECTOR ASSEMBLY

[75] Inventor: Robert G. Dickie, Newmarket, Canada

[73] Assignee: Spark Innovations, Inc., Newmarket, Canada

[21] Appl. No.: 345,787

[22] Filed: May 1, 1989

[51] Int. Cl.[5] ..... H01R 13/648; H01R 13/58

[52] U.S. Cl. ..... 439/460; 439/465; 439/610

[58] Field of Search ..... 439/98, 99, 610, 449, 439/455, 460, 465–467

[56] References Cited

U.S. PATENT DOCUMENTS

| | | | |
|---|---|---|---|
| 3,076,169 | 1/1963 | Blaisdell | 439/99 |
| 3,336,565 | 8/1967 | Crimmins | 439/459 |
| 3,781,766 | 12/1973 | Teagno et al. | 439/455 |
| 4,108,527 | 9/1978 | Douty et al. | 339/107 |
| 4,272,148 | 6/1981 | Knack | 339/143 |
| 4,585,922 | 4/1986 | Berenson | 439/447 |
| 4,629,276 | 12/1986 | Genaro et al. | 439/449 |
| 4,640,984 | 2/1987 | Kalbfeld | 439/465 |

FOREIGN PATENT DOCUMENTS

| | | | |
|---|---|---|---|
| 2097601 | 11/1982 | United Kingdom | 439/460 |

*Primary Examiner*—Gary F. Paumen

*Attorney, Agent, or Firm*—Robert O. Nimtz

[57] ABSTRACT

A multiconductor shielded connector is disclosed in which a flexible, compressible double bushing is used between the connector half shells and the multiconductor cable. The double bushing comprises an outer bushing dimensioned to grasp the outer jacket of the cable at the exiting end of the connector. A concentric, longitudinally offset inner bushing is inserted under the shielding (braid or foil) and mates with ridges on the inner surface of the half shells to form a tight, continuous radiation seal. The inner and outer bushings are connected together with a fine web which maintains concentricity and axial displacement of the bushings before and during assembly, but which does not interfere with the operation of the connector after assembly. The outer bushing may have a sleeve extending outside of the half shells to prevent sharp bends at the connector exit. A single bushing can be used which defines a serpentine cable path when it is desired to use the same half shells with non-shielded cable. In that case, the bushing merely provides strain relief. Both the double bushing and the single bushing can be supplied in graduated thicknesses to permit a single pair of connector half shells to accommodate a large variety of cable diameters.

11 Claims, 2 Drawing Sheets

SHIELDED CONNECTOR ASSEMBLY

TECHNICAL FIELD

This invention relates to electrical connector assemblies and, more particularly, to universal connector assemblies which provide continuous shielding for connectors used with shielded cables, and which provides non-destructive strain relief for cables with or without shielding.

BACKGROUND OF THE INVENTION

The increased use of miniaturized electronics for data processing, signal processing and electrical component control circuits has required a corresponding increase in the demand for the multi-conductor connectors needed to connect such electronic components together. In some applications, such as in high security areas, in areas particularly sensitive to electromagnetic radiation, and in areas where such radiation might be considered a health hazard, it is necessary to provide electromagnetic shielding for such equipment, for the cables interconnecting such equipment, and for the connectors terminating such cables.

Shielded connectors for multi-conductor cables are well-known. Such connectors must provide a surrounding shell which is conductive in order to shield the internal wires and a mechanism for completing a radiation-tight electrical connection between the metallic shell and the conductive braid or foil surrounding the wires of the cable. Finally, the connector must provide physical attachment of the connector to the cable which does not allow strain on the electrical connection of the wires to the connector terminals nor of the electrical connection of the cable shielding to the connector housing.

It has become common in shielded connector technology to provide such strain relief and such connection to the braid or foil surrounding the cable by peeling the outer insulation layer or jacket away from the braid or foil, folding the braid or foil back over the outer jacket and clamping both the layer of braid or foil and the cable with a bushing or metallic ferrule which completes the electrical circuit between the braid or foil and the conductive connector shell and, at the same time, clamps the cable with sufficient strength to provide strain relief for the electrical connections inside of the connector assembly. Such shielded connector assemblies have become well-known in the art and are typified by A. C. Knack Pat. No. 4,272,148, granted June 9, 1981. Other prior art connector assemblies utilize a metallic ferrule crimped directly over the shielding layer.

Such shielded connector assemblies of the prior art have had several difficulties. In the first place, the steps of peeling back the outer insulator layer and folding back the conductive braid or foil are time-consuming and require a great deal of dexterity. Moreover, the exposed braid or foil is fragile and often tears either in the act of folding it back over the outer insulative layer, or as a result of the shearing forces generated when crimping during assembly. Since the braid or foil is directly clamped, all of the strain relief forces are transmitted through the braid or foil, again causing the braid or foil to tend to tear or distort in use. Once torn or distorted, the braid or foil can no longer provide a complete and continuous electromagnetic shielding for the connector-cable combination. A torn braid or foil also loses some of its ability to provide adequate strain relief. As a result, prior art shielded connectors often fail, either in providing adequate shielding, or in providing adequate strain relief, or in both, either initially, due to lack of care in assembling the connector to the cable, or during use, due to damage done while relieving strain on the electrical connections during plugging and unplugging operations. Moreover, such prior art connector assemblies required considerable time and expertise in order properly to assemble the parts.

SUMMARY OF THE INVENTION

In accordance with the illustrative embodiment of the present invention, these and other problems are overcome by a shielded connector construction which strain relief is provided by forces applied directly to the outer jacket or insulation rather than through the shielding layer. Rather than peeling back the shielding layer, a bushing is inserted under the shielding layer, pushing the layer outwardly to contact the conductive inner surface of the connector. These two functions, strain relief and shielding, can advantageously be provided by a double bushing. The double bushing comprises two axially concentric, compressible bushings of differing diameters and axially offset from each other. The outer bushing has at least one inwardly extending ridge or buttress and at least one outwardly extending ridge. The two concentric bushings are attached together by webs connecting the rear end of the outer bushing with the rear end of the inner bushing in order to maintain concentricity and axial spacing of the two bushings.

During assembly, the outer jacket of the cable is cut back to expose a section of the shielding layer. The double bushing is then inserted over the inner cable conductors such that the leading edge of the outer bushing slides over the outside of the shielding layer and the outside of the outer jacket. The inner bushing is of smaller diameter and pushes the shielding layer back on the inner cable until the shielding layer expands sufficiently to allow the inner bushing to slide under the shielding layer. A tapered or beveled nose can be provided on the leading edge of the inner bushing to facilitate insertion under the shielding layer. When the connector cover halves are assembled over the inserted double bushing, the outer bushing is engaged in a slot in the outer part of the connector halves and forces the inwardly facing ridge to seize the outer jacket of the cable. At the same time, inner portions of the connector halves engage the braiding against the outside of the inner bushing. The inner and outer portions of the connector halves are dimensioned such that the greater percentage of the closing force is exerted at the outer portion, thereby providing excellent strain relief. At the same time, the inner portion of the connector halves engage the braided shielding to complete the electromagnetic shield.

A single connector cover size can be made to serve various sized cables by providing a plurality of differently sized double bushings, each dimensioned to take up the space between the variously sized cables and the fixed sized connector halves. This technique is known for single bushings as shown in G. H. Douty et al. Pat. No. 4,108,527, granted Aug. 22, 1978. Moreover, a plurality of specially shaped single bushings can be used with the same connector halves to provide strain relief for non-shielded cables of various sizes.

An advantage of the present invention is that the length of the exterior cable jacket that is removed is not critical since any excess length of wires can be looped or accordion pleated inside the connector cover. Likewise, any excess length of the shielding layer will also merely extend into the cover cavity. The assembly of the double bushing shielded connector of the present invention therefore involves no critical steps and can be performed by personnel without any special tools and with little or no experience or training.

BRIEF DESCRIPTION OF THE DRAWINGS

A complete understanding of the present invention may be gained by considering the following detailed description in conjunction with the accompanying drawing, in which.

To facilitate reader understanding, identical reference numerals are used to designate elements common to the figures.

DETAILED DESCRIPTION

Figure 1:
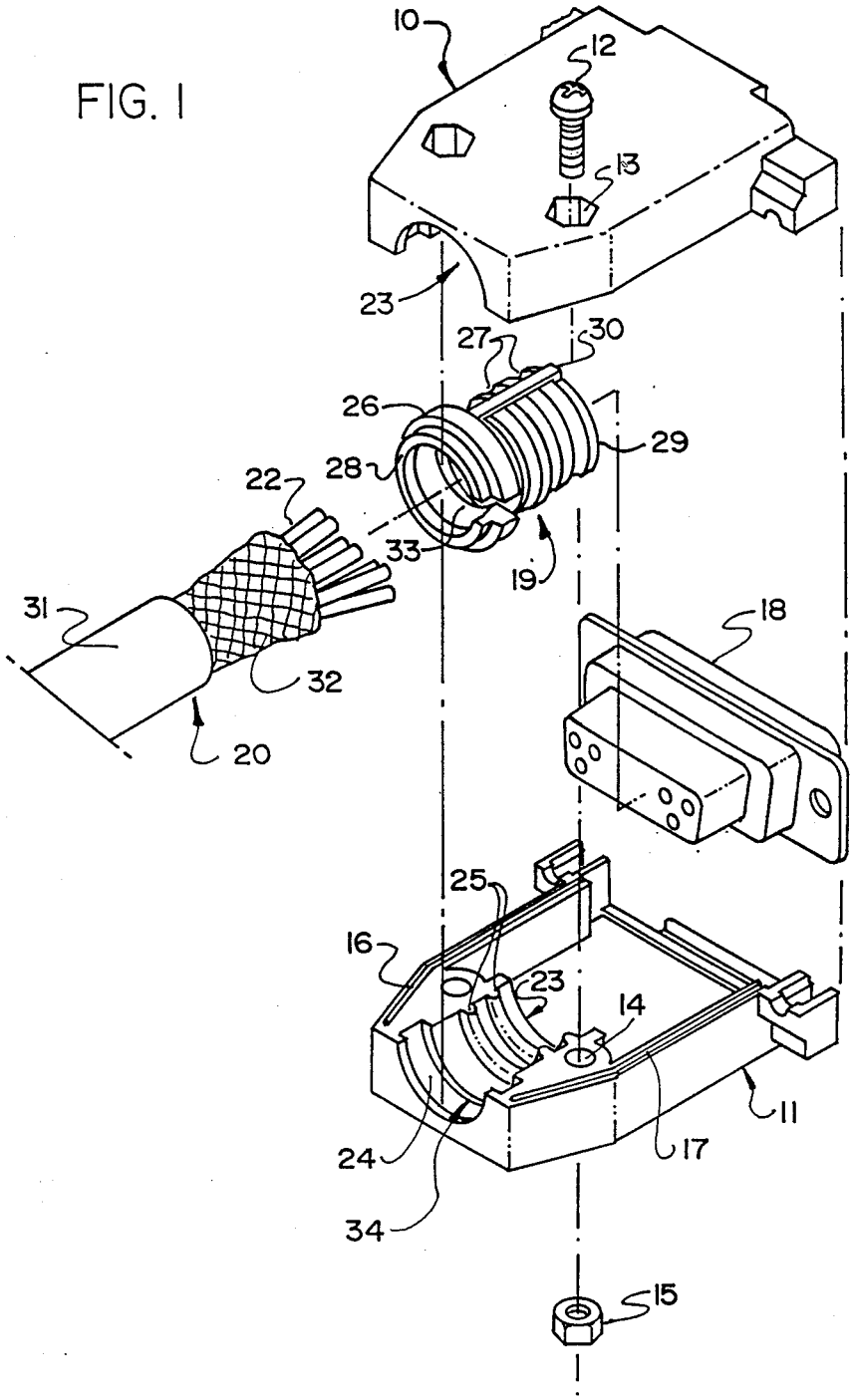
FIG. 1 shows a perspective, exploded view of a shielded connector assembly using a double bushing in accordance with the present invention.

Referring more particularly to FIG. 1, there is shown a perspective exploded view of a shielded connector assembly in accordance with the present invention. The connector assembly of FIG. 1 comprises a first half shell member 10 and a second half shell member 11. The half shells 10 and 11 are designed to fit together as shown in the cross-sectional view of FIG. 2, to form a box-like enclosure. The half shell members 10 and 11 are maintained in a closed position by screws such as screw 12 inserted through hole 13 in half shell 10, through hole 14 in half shell 11, and fastened by nuts such as nut 15. Ridges 16 and 17 on the mating surface of lower half shell 11 fit snugly into matching grooves (not visible in FIG. 1) on the mating surface of upper half shell 10 to insure accurate registration when the half shells 10 and 11 are fastened together, and to provide a labyrinthine path for radiation leakage. In accordance with well-known connector technology, the half shells 10 and 11 can be fabricated by die casting metal or by molding plastic. If a plastic connector is to provide electromagnetic shielding, the plastic half shells must be coated with a conductive layer to provide the necessary shielding.

When closed, half shells 10 and 11 capture an electrical connector head 18 at one end thereof and capture a double bushing 19 and a shielded cable 20 at the opposite end thereof. In the course of assembly, the ends of wires 22 of cable 20 are connected to electrical contacts at the rear of connector head 18 to complete an electrical circuit from the wires 22 through the connector head 18 to equipment having a mating connector head, all in accordance with well-known connector technology. For convenience, the right hand end of the half shells 10 and 11 at which the connector head 18 is located will be called the head or front of the connector assembly of FIG. 1, and the opposite, left hand end will be called the tail or rear of the connector assembly. The construction of the head or front of the connector assembly of FIG. 1 can be done in accordance with well-known principles and forms no part of the present invention, and will not be further described here.

The rear or tail ends of the half shells 10 and 11 define a cylindrically shaped passage 23 having a transverse circumferential or peripheral groove 24 at the tail end thereof and having a plurality of transverse circumferential or peripheral ridges 25 near the head or front end thereof. Bushing 19 includes a ridge 26 which mates with the groove 24 and a plurality of grooves 27 which mate with the ridges 25 when the half shells 10 and 11 are brought together around bushing 19.

Figure 2:
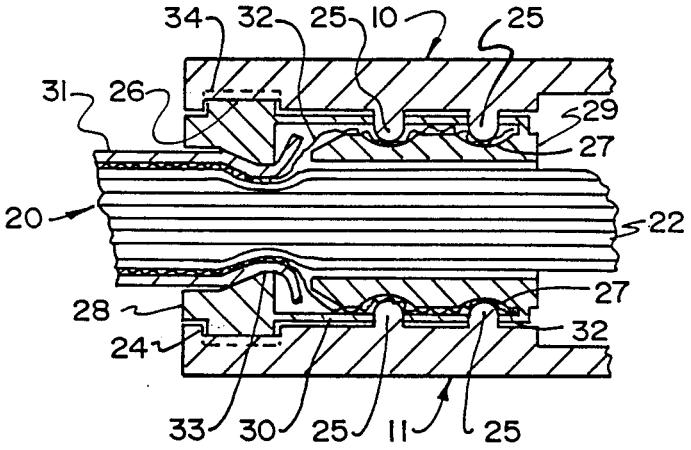
FIG. 2 is a longitundinal, cross-sectional view of a portion of the assembled connector shown in FIG. 1, showing details of the double bushing strain relief and shielding in accordance with the present invention.

Bushing 19, shown in more detail in FIG. 2, is actually two separate bushings 28 and 29, held in a coaxial but longitudinally offset relationship by a pair of thin web members 30 at diametrically opposite sides of the double bushing 19. The rear outer bushing 28 has an inner diameter sufficiently large to fit easily over the outer jacket 31 of cable 20. Bushing 28 may be split at one point in its circumference to facilitate slipping it over jacket 31. The outer surface of bushing 28 includes the circumferential ridge 26 which mates with the groove 24 in the half shells 10 and 11.

The front inner bushing 29 has an inner diameter sufficiently large to fit over the bundle of wires 22 in cable 20, but not sufficiently large to fit over a braided metallic shielding 32 enclosing the wires 22. The outer surface of inner bushing 29 has circumferential grooves 27 which mate with the ridges 25 in half shells 10 and 11. As can best be seen in FIG. 2, the rear end of inner bushing 29 is beveled so that inner bushing 29, when pushed over the bundle of wires 22, tends to slip under the braided layer 32.

The completed connector assembly of the present invention is assembled as follows: First, the outer jacket 31 of the cable 20 is stripped back from the ends of wires 22 by a distance approximately the length of the connector housing. The braided shielding 32 is, in turn, stripped back from the ends of wires 22 to a distance from the jacket approximately equal to the length of the double bushing 19. The indidual wires 22 are then stripped and attached to to electrical contacts at the rear face of the connector head 18. The length to which the jacket 31 and the braiding 32 are stripped back is not critical, so long as the wires 22 reach the connector head 18. Any reasonable excess length of wires 22 or braiding 32 can be accommodated within the cavity behind connector head 18 and in front of hole 23.

Next, the double bushing 19 is inserted over the wires 22. The leading edge of the inner bushing 29 pushes the braided shielding 32 back on the wires 22. As the braiding 32 is pushed back, it tends to expand in diameter until the beveled leading edge of inner bushing 29 slips under the braiding. The double bushing 19 continues to be pushed in until the nose or leading edge of the inner bushing 29 rests against the edge of the jacket 31 of cable 20. At this point, the outer bushing 28 is located over the end of the jacket 31. Outer bushing 28 may be sprung open somewhat to facilitate its passage over the end of jacket 31, thus taking advantage of the split in the outer bushing 28. The double bushing will tend to stay in place during the balance of the assembly of the connector in a manner similar to the "Chinese Finger Lock." That is, any attempt to pull the bushing 29 out from under the braiding 32 causes the braiding to shrink in diameter and grasp the bushing 29 more firmly. At this time, the individual wires 22 can be connected to the rear of the connector head 18 in accordance with well-known and standard practices.

Once the connector head 18 is attached to the wires 22, the two half shells 10 and 20 can be assembled over the cable and connector head assembly, using screws such a screw 12. The webs 30 are oriented directly towards the half shells 10 and 11, and away from the vicinity of the mating surfaces. This prevents the webs 30 from becoming pinched between the half shells 10 and 11 and thus preventing full closure of the half shells. The ridge 26 must be mated with the groove 24 and the grooves 27 mated with the ridges 25. At the same time, the connector head 18 must be mated with the front end of the half shells 10 and 11. Any reasonable excess of wires 22 or of braiding 32 extending beyond the trailing edge of inner bushing 19 can be looped or accordion pleated between head 18 and bushing 19 simply by pushing head 18 toward bushing 19. The cavity formed by the half shells 10 and 11 will readily accommodate such loops or accordion pleats.

When the half shells 10 and 11 are closed by screws 12, the ridge 26 on outer bushing 28 is locked into the groove 24 to securely fasten the bushing to the half shells. At the same time, a ridge or buttress 33 on the inner diameter of outer bushing 28 engages and pinches the outer jacket 32 of cable 20 to provide strain relief. That is, any forces exerted on the cable 20 are transferred to the connector housing formed by half shells 10 and 11 rather than to the electrical connections at the rear of connector head 18. This prevents the electrical connections from being damaged by such forces.

As is better shown in FIG. 2, the braided shielding 32 is captured between the outer surface of inner bushing 29 and the inner surface of the hole 23 in the area of ridges 25. As the half shells 10 and 20 are closed, the conductive inner surface of the half shells are brought into intimate contact with the metallic braiding 32. This intimate contact provides an essentially continuous electrical contact which insures a continuous electromagnetic shield. The thin webs 30 become deformed by the mating grooves and ridges and enmeshed in the conductive braiding.

In accordance with the preferred embodiment of the present invention, the half shells 10 and 11 are made of some high impact plastic such as polystyrene or ABS with a conductive coating. The double bushing 19 is made of a slightly flexible material such as polyvinychloride (PVC) with a rigidity of 80 to 90 durometers. The half shells could, of course, be die cast metal, and the bushing 19 could include powdered carbon or other conductive material to further improve the shielding. In further accord with the present invention, the various grooves and ridges are fashioned such that the majority of the force exerted by the closing half shells 10 and 11 is exerted in the area of the outer, strain relief, bushing 28. Preferably, approximately 70% of the force should be exerted at the outer bushing to provide strain relief, and only about 30% used to complete the electrical circuit with the shielding at the inner bushing.

Referring to FIG. 2, there is shown a cross-sectional view of the fully assembled connector illustrated in exploded view in FIG. 1. Identical elements are identified with the same reference numerals. Only the rear or tail end of the connector assembly is shown in FIG. 2 since the head or connection end is constructed in accordance with the known technology and forms no part of the present invention. As best seen in FIG. 2, the surface of groove 24 can include a plurality of triangular longitudinal ridges 34 which assist in providing torsional strain relief. The pointed tops of these longitudinal ridges 34 depress and engage the outer surface of the outer bushing 28 to "grasp" the bushing and prevent rotational movement within the connector shell.

As also can be best seen in FIG. 2, the radius of curvature of the grooves 27 is substantially greater than the radius of curvature of the ridges 25, thus providing significant open space in the vicinity of their closure. This space is therefore advantageously available to take up unevenesses and variations in the weave of the braiding 32, and to accommodate any misregistration of the ridges 25 to the grooves 27, thereby facilitating continuous intimate closure of ridges 25 on the braiding 32.

The flexibility and compressibility of the bushing material allows the bushings to be deformed so as to fill all tolerances between the other parts of the connector assembly. Moreover, the bushing is slightly compressed during assembly and hence can expand to continue to fill these tolerances even when the screws connecting the half shells loosen. The connector assembly of the present invention therefore does not fail simply because of loosened screws.

As noted above, in many prior art connector assemblies, the braiding or foil is folded back over the outer jacket of the cable. This double layer performed strain relief and electrical connection to the shielding in the same longitudinal area. The present invention, on the other hand, separates the areas in which these two functions are performed. Since the force necessary to provide adequate strain relief tends to be so great as to deform and tear the braiding, the electromagnetic shielding qualities of the prior art connectors tended to deteriorate with improvements in the strain relief capabilities, and vice versa. By separating these areas, the present invention permits each function to be independently served without deleterious effects on the other. Moreover, the step of folding the braiding back over the jacket, required in the prior art devices, tends to unweave, stretch, distort and possibly tear the braiding, thereby leaving gaps in the electromagnetic shielding. It also permits part of the braiding to be pinched between the half shells, thereby preventing the half shells from mating and providing adequate strain relief and shielding. This step of properly folding back the braiding is therefore timeconsuming and requires a certain degree of skill, increasing the cost of assembly. Finally, the thickness of the braiding adds to the overall thickness of the assembled connector, resulting in connector designs with higher profiles.

A single size of half shells 10 and 11 can be made to serve for various sizes of cables 20 by providing a plurality of different bushings 19 with each pair of half shells. Since the cost of the bushings is much less than the cost of the shells, a pair of shells can be economically packaged with a plurality of bushings, possibly molded together on a common molding "tree," which bushings are of varying thicknesses to accommodate cables of different diameter. Due to the compressibility of the PVC bushings, a continuum of cable sizes can readily be accommodated with a relatively small number of bushing sizes.

Figure 3:
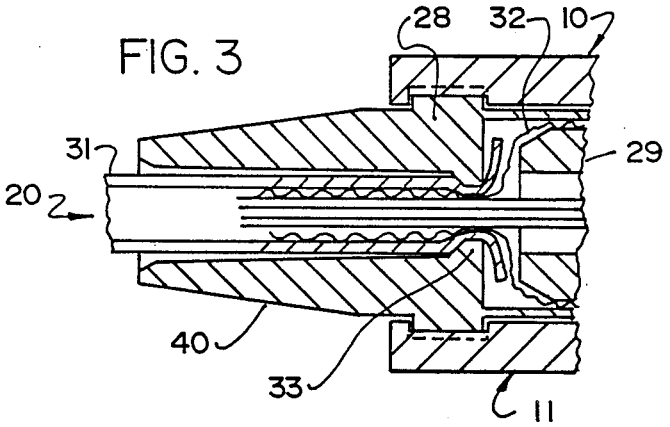
FIG. 3 is a longitudinal, cross-sectional view of a portion of another assembled connector showing the use of an extended outer bushing sleeve to provide protection against excessive bending at the connector entry.

As shown in FIG. 3, the outer bushing 28 can include an extended sleeve or tail portion 40 which extends for some distance over the outer jacket 31 of the cable 20. The sleeve 40 prevents the cable 20 from bending at sharp angles in the neighborhood of the connector cover, thereby preventing excessive forces from damaging the cable or the various internal parts of the connector assembly.

Figure 4:
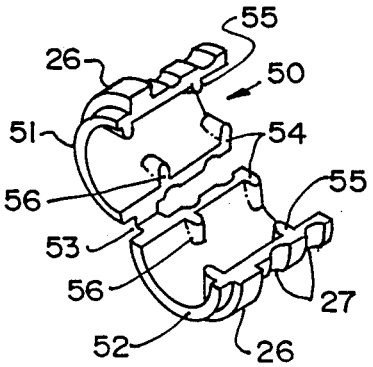
FIG. 4 is a perspective view of a split single bushing which may be used in the attachment of non-shielded cables to the connector shells of the present invention.

The shielded connector architecture of the present invention can be readily adapted to non-shielded connectors by using a split bushing such as that illustrated in FIG. 4. The bushing 50 of FIG. 4 has two mating halves 51 and 52 which, when closed on each other, form a cylindrical bushing having an outer surface which mates with the inner surface of the half shells 10 and 11 of FIGS. 1, 2 and 3. Bushing 50 is made of plastic material such as polypropylene of sufficient strength and flexibility to permit the halves 51 and 52 to be attached only at one point 53 on ridge 26. Point 53 therefore acts as "living hinge" between the two halves 51 and 52. The inner surface of bushing 50 has a plurality of longitudinally offset barriers 54, 55 and 56 which form a serpentine path through the center of bushing 50 when the halves are mated together.

Figure 5:
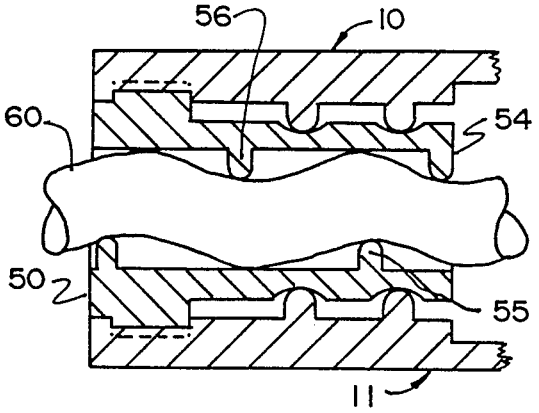
FIG. 5 is a longitudinal, cross-sectional view of an assembled connector using the bushing of FIG. 4 to provide strain relief for non-shielded cables while using the same connector halves as are used for shielded cables.

In use, a cable 60 is placed inside of bushing 50 by bending it to follow the serpentine path. This is better shown in the longitudinal cross-section of FIG. 5. When the half shells 10 and 11 are assembled around bushing 50, the inner surfaces of the half shells engage the bushing 50 just as they engage the outer surface of the double bushing 19 shown in FIGS. 1, 2 and 3. This forces the inner barriers 54, 55 and 56 on bushing 50 to grasp the outer jacket of cable 60 so as to prevent longitudinal or torsional movement. The bushing 50 therefore acts to provide strain relief for non-shielded cable, using the same connector half shells as are used for shielded cable. Indeed, a plurality of single bushing 50 can be provided to accommodate non-shielded cables of various sizes. The serpentine engagement of the cable inside of the bushing 50 permits a relatively small number of bushing sizes to accommodate a large range of cable sizes. These single bushings can also be manufactured attached to a holding "tree" and packaged with the connector shell halves, the connector head, the screws and the double bushings for shielded cables. A single package or kit can therefore serve to provide a standard sized connector assembly for a large number of differently sized cables which can be shielded or unshielded. Moreover, little or no training is required to properly assemble the connector assembly due to the large tolerances allowed in the stripping and the fact that it is unnecessary to fold the shielding back over the cable jacket. In spite of being easier to assemble, the connector assembly of the present invention provides superior shielding and superior strain relief as compared to the prior art connector assemblies due to the physical separation of, and separate control over, the shielding and the strain relieving functions.

It should also be clear to those skilled in the art that further embodiments of the present invention may be made by those skilled in the art without departing from the teachings of the present invention.

What is claimed is:

1. An electrical connector assembly comprising:

a pair of connector half shells which, when mated together, define therebetween an enclosed space having a front entry and a rear entry, said front entry being arranged to receive a connector block for providing electrical connections for a plurality of conductors, said rear entry being arranged to receive a multiconductor cable including an outer jacket, an intermediate conductive shielding layer and an interior plurality of conductors, and a one piece double bushing arrangement having an external bushing dimensioned to fit on the outside of said outer jacket and an internal bushing coaxial with said external bushing but with a substantially smaller inner diameter and dimensioned to fit over said interior plurality of conductors such that, when said half shells are mated together, said external bushing grasps said outer jacket to provide strain relief and said internal bushing forces said intermediate conductive layer outwardly against said rear entry surface without folding said intermediate conductive layer to provide a continuous electromagnetic shield around said conductors.

2. The electrical connector assembly according to claim 1 wherein said double bushing arrangement is fabricated of flexible and compressible material which permits said bushing to be deformed so as to fill the tolerances between said rear entry and said multiconductor cable.

3. The electrical connector assembly according to claim 1 wherein said external and said internal bushings of said double bushing arrangement are connected together by a plurality of thin webs holding said external and internal bushings in axial alignment and longitudinally displaced from one another.

4. The electrical connector assembly according to claim 1 wherein said rear entry includes a circumferential groove near the rearwardmost end of said entry, and said outer bushing includes a ridge which matches said circumferential groove and locks in said groove when said half shells are assembled together.

5. The electrical connector assembly according to claim 1 wherein said rear entry includes at least one circumferential ridge near the forwardmost end of said rear entry, and said inner bushing includes at least one groove which matches said circumferential ridge and locks into said ridge when said half shells are assembled together.

6. The electrical connector assembly according to claim 1 wherein said outer bushing includes an sleeve which extends outwardly from said half shells and over a portion of said outer jacket to prevent bending said cable at a sharp angle at said rear entry.

7. A connector assembly kit comprising:

a pair of mating connector half shells which, when mated together, define a box-like enclosure therebetween having a forward entry and a rearward entry, a connector block adapted to provide electrical connections for a plurality of electrical conductors and dimensioned to be snugly received in said forward entry, a plurality of compressible one-piece double bushings of different sizes each dimensioned to fit between said rearward entry and a shielded multiconductor cable of a different size, each said shielded cable having an outer jacket, an inner bundle of conductors and an intermediate conductive layer, each said double bushing comprising an outer bushing dimensioned to fit over the outer jacket of one of said shielded cables and an inner bushing coaxial with but of a substantially smaller inner diameter than said outer bushing and dimensioned to fit between said inner bundle of conductors and said conductive layer on the same shielded cable, and means for attaching said half shells together to engage said outer bushing with said outer jacket to provide strain relief and to allow paid inner bushing to force layer outwardly against interior surface of said rearward entry without folding said conductive layer to provide a continuous electromagnetic shield said inner bundle of conductors.

8. The connector assembly kit according to claim 7 further including a plurality of compressible single bushings of different sizes each dimensioned to fit between said rearward entry and a non-shielded multiconductor cable of a different size, each said non-shielded cable having an outer jacket surrounding an inner bundle of conductors, each said single bushings including interior offset barriers defining a longitudinal serpentine path through the center of said single bushing for receiving one size of said non-shielded cable to provide strain relief for said non-shielded cable.

9. The connector assembly kit according to claim 8 wherein each said single bushing is manufactured in mating halves which are hinged together to facilitate assembly around said non-shielded cables.

10. A method for assembling an electrical connector to the end of a multiconductor cable including an outer jacket, an inner bundle of conductors and an intermediate shielding layer, said method comprising the steps of:

trimming said outer jacket of said multiconductor cable back away from said end of said cable by a preselected distance, trimming said intermediate shielding layer back away from said end of said cable by a distance less than said preselected distance, inserting a double one-piece compressible bushing over the end of said cable such that an outer bushing slides over said outer jacket and an inner bushing slides between said inner bundle of conductors and said shielding layer, connecting the ends of said conductors to a connector block, and assembling a pair of mated connector half shells around said connector block and around said double bushing so as to capture said connector block at one end of said half shells and to capture said double bushing at the other end of said half shells, said half shells grasping said outer bushing to provide strain relief, and said half shells grasping said shielding layer without folding of said shielding layer to provide electromagnetic shielding.

11. The method according to claim 9 further including the step of selecting one of a plurality of said double bushings of different thicknesses, the selected one of said double bushings having a thickness which fits snugly between said half shells and a cable of a particular size.

* * * * *